US009755330B2

(12) United States Patent
Rodriguez et al.

(10) Patent No.: US 9,755,330 B2
(45) Date of Patent: Sep. 5, 2017

(54) LOW VOLTAGE CONNECTOR

(71) Applicants: Chien Luen Industries Co., Ltd., Inc., Oakland Park, FL (US); KTE Electrical Ltd., Tsuen Wan (HK)

(72) Inventors: Jonathan Rodriguez, Fort Lauderdale, FL (US); Memie Wong Mei Mei, Sai Kung (CN)

(73) Assignees: Chien Luen Industries Co., Ltd., Inc., Oakland Park, FL (US); KTE Electrical Ltd., Hong Kong (CN)

( * ) Notice: Subject to any disclaimer, the term of this patent is extended or adjusted under 35 U.S.C. 154(b) by 0 days.

(21) Appl. No.: 15/172,810

(22) Filed: Jun. 3, 2016

(65) Prior Publication Data

US 2016/0285180 A1 Sep. 29, 2016

Related U.S. Application Data

(60) Division of application No. 14/707,436, filed on May 8, 2015, now Pat. No. 9,362,636, which is a (Continued)

(51) Int. Cl.

| | |
|---|---|
| ***H01R 4/24*** | (2006.01) |
| ***H01R 11/20*** | (2006.01) |
| ***H01R 9/11*** | (2006.01) |

(52) U.S. Cl.

CPC ..... *H01R 11/20* (2013.01); *H01R 4/2404* (2013.01); *H01R 4/2408* (2013.01); *H01R 9/11* (2013.01)

(58) Field of Classification Search

CPC .... H01R 11/20; H01R 4/2404; H01R 4/2408; H01R 4/2433; H01R 4/2454; H01R 9/11; H01R 13/6392

(Continued)

(56) References Cited

U.S. PATENT DOCUMENTS 3,115,541 A 12/1963 Hanner et al.
3,821,691 A 6/1974 Reimer (Continued)

FOREIGN PATENT DOCUMENTS

JP 10247530 9/1998

OTHER PUBLICATIONS

Chien Luen Industries Co., Ltd., Inc., Low Voltage Connector, PCT Patent Application No. PCT/US2015/5029891 filed May 8, 2015, Notification of Transmittal of the International Search Report and the Written Opinion of the International Searching Authority, or the Declaration mailed Aug. 26, 2015, 11 pages.

(Continued)

*Primary Examiner* — Jean F Duverne
(74) *Attorney, Agent, or Firm* — Brian S. Steinberger; Law Offices of Brian S. Steinberger, P.A.

(57) ABSTRACT

Electrical wiring connector assemblies, devices, systems, apparatus, and methods for establishing circuit connections between insulated wire conductors without removing the insulation from the conductors, such as attaching a power conductor cable to multiple lights such as those used with pathway and landscape lights, and the like. The connector can include two legs hinged together with placement and penetrating members on the insides of the legs which when pushed together by squeezing the legs can penetrate the insulated layer of the insulated wire conductor to establish an electrical connection. Pivotable wire lead ports allow for wire leads to other lights to be hooked to the insulated wire conductor.

16 Claims, 20 Drawing Sheets

Related U.S. Application Data continuation-in-part of application No. 14/291,308, filed on May 30, 2014, now Pat. No. 9,147,946.

(60) Provisional application No. 61/990,781, filed on May 9, 2014.

(58) Field of Classification Search
USPC ..... 439/410
See application file for complete search history.

(56) References Cited

U.S. PATENT DOCUMENTS

| | | | | |
|---|---|---|---|---|
| 4,037,905 | A | 7/1977 | Lucas | |
| 4,047,784 | A | 9/1977 | Trank | |
| 4,070,082 | A | 1/1978 | Werner | |
| 4,283,104 | A | 8/1981 | Pemberton | |
| 4,516,822 | A | 5/1985 | Wolfel | |
| 4,648,674 | A | 3/1987 | Sanchez, Jr. | |
| 4,749,367 | A | 6/1988 | Fraser | |
| 4,793,824 | A | 12/1988 | Cozzens et al. | |
| 4,861,278 | A | 8/1989 | McBride et al. | |
| 4,921,439 | A | 5/1990 | Bofill et al. | |
| 4,941,844 | A | 7/1990 | Bowden et al. | |
| 5,102,354 | A * | 4/1992 | Crane | H01R 13/719 439/607.28 |
| 5,378,171 | A * | 1/1995 | Czerlanis | H01R 11/20 439/417 |
| 5,601,448 | A | 2/1997 | Poon | |
| 5,888,090 | A | 3/1999 | Achee | |
| 5,975,938 | A | 11/1999 | Libby | |
| 6,159,035 | A | 12/2000 | Smith, III | |
| 6,312,282 | B1 | 11/2001 | Blaha et al. | |
| 6,364,690 | B1 | 4/2002 | Nehm-Engelberts | |
| 6,860,752 | B2 * | 3/2005 | McCoy | H01R 4/4818 439/397 |
| 7,066,764 | B2 * | 6/2006 | Bolouri-Saransar | H01R 4/2433 439/409 |
| 7,134,903 | B1 * | 11/2006 | Pavlovic | H01R 4/2454 439/404 |
| 7,429,186 | B2 * | 9/2008 | Mrakovich | F21V 21/002 439/404 |
| 7,442,070 | B2 * | 10/2008 | Lee | F21V 21/002 362/249.01 |
| 7,448,900 | B1 * | 11/2008 | Chen | H01R 4/2412 439/402 |
| 7,540,758 | B2 * | 6/2009 | Ho | H01R 4/2408 174/78 |
| 7,604,498 | B2 * | 10/2009 | Mahajan | H01R 4/2404 174/71 R |
| 7,811,117 | B2 * | 10/2010 | Andrade | H01R 13/6392 439/373 |
| 8,647,147 | B2 * | 2/2014 | Chartrand | H01R 4/2404 439/425 |
| 9,147,946 | B1 | 9/2015 | Wong | |
| 2006/0160403 | A1 | 7/2006 | Duesterhoeft et al. | |

OTHER PUBLICATIONS

Chien Luen Industries Co., Ltd., Inc., PCT Patent Application No. PCT/US2015/029891 filed May 8, 2015, Notification Concerning Transmittal of International Preliminary Report on Patentability mailed Nov. 24, 2016, 8 pages.

* cited by examiner

LOW VOLTAGE CONNECTOR

CROSS REFERENCE TO RELATED APPLICATIONS

This application is a Divisional Patent Application of U.S. patent application Ser. No. 14/707,436 filed May 8, 2015, now U.S. Pat. No. 9,362,636, which claims the benefit of priority to U.S. Provisional Application Ser. No. 61/990,781 filed May 9, 2014, and this application is a Continuation-In-Part of U.S. patent application Ser. No. 14/291,308 filed May 30, 2014, now U.S. Pat. No. 9,147,946. The entire disclosure of each of the applications listed in this paragraph are incorporated herein by specific reference thereto.

FIELD OF INVENTION

This invention relates to electrical wiring connectors, and in particular to connector assemblies, devices, apparatus, systems and methods for establishing circuit connections between insulated wire conductors without removing the insulation from the conductors, such as attaching a power conductor cable to multiple lights such as those used with pathway and landscape lights, and the like.

BACKGROUND AND PRIOR ART

Attaching electrical powered products, such as a series of lights to a main insulated wire conductor often required the installer having to remove part of the insulation layer to expose the underlying wire conductor so that additional connections to other lights can be made. Having to strip off the insulation is both time consuming and also requires the installer reseal the connection which is often done by electrical tape and the like. The use of temporary covers such as electrical tape is not desirable in outside applications, since the tape can easily degrade and fall off over time exposes the bare wire conductor.

Attempts have been made of the year to pierce the insulation layer with prong type components. See for example, U.S. Pat. No. 5,378,171 to Czerlanis. However, this connector arrangement requires to separate prong pieces that must be separately manipulated and pushed together. If the parts are not precisely and exactly manipulated together the prongs may not couple with one another. Furthermore, having two separate prong pieces raises the likelihood of losing a prong piece if an installer needs to make multiple connections off a main insulated wire conductor.

Additionally the prong pieces have exposed sharp portions for use in penetrating the insulator, which can potentially stick into and injure the installer trying to push the prongs with sharp points together.

Along a low-voltage 12V DC (direct current) or AC (alternating current) power supply cable of a landscape lighting system, it is possible to draw electrical power from the cable at any desired position for supplying power to an electrical device and in particular a lighting fixture in a garden or front/back yard where lighting is desired. A specific type of electrical connector is used for this purpose, which is mounted on the cable at that position and is then screwed tight to pierce a pair of sharp pins into the cable cores for extracting power.

Connectors of this type are known in general. See for example, U.S. patents: U.S. Pat. No. 5,601,448 to Poon, and U.S. Pat. No. 6,364,690 to Nehm-Engelberts. But these connectors are not convenient to use. For example, the cable leading to the electrical device is cumbersome to connect or disconnect. Such connectors are often material and/or labor intensive to manufacture.

Thus, the need exists for solutions to the above problems with the prior art.

SUMMARY OF THE INVENTION

A primary objective of the present invention is to provide electrical wire connector assemblies, devices, apparatus, systems and methods for establishing circuit connections between insulated wire conductors without removing the insulation from the conductors, such as attaching a power conductor cable to multiple conductor lines to lights such as those used with pathway and landscape lights, and the like.

A secondary objective of the present invention is to provide electrical wire connector assemblies, devices, apparatus, systems and methods for establishing circuit connections between insulated wire conductors with a one piece hinged unit allowing penetrating members to push together penetrating insulation layers of the conductors.

A third objective of the present invention is to provide electrical wire connector assemblies, devices, apparatus, systems and methods for establishing circuit connections between insulated wire conductors which protects the installer from being stuck and injured.

A fourth objective of the present invention is to provide a one piece electrical wire connector assemblies, devices, apparatus, systems and methods for establishing circuit connections between insulated wire conductors without removing the insulation from the conductors, which can be operated to penetrate the insulation layers with one hand.

According to the invention, there is provided an electrical cable connector for electrically connecting a second electrical cable to a first electrical cable having two cores with insulation. The electrical cable connector has a body having a first body member and a second body member which are connected together and are movable from an open position in which the first and the second body members are relatively spaced apart to a closed position in which the first and second body members are relatively close together. Included are a first conductor supported by the first body member and a second conductors supported by the second body member. The first and second conductors have respective ends protruding from the corresponding first and second body members, the ends points in opposite directions along an imaginary plane when the first and second body members are in the close position.

Further included is a gap associated with at least one of the first and second body members through which gap the imaginary plane extends, for receiving and locating a section of the cores of a said first electrical cable on the same imaginary plane when the first and second body members are moved to the closed position with the ends of the first and second conductors simultaneously cutting through insulation and coming into electrical connection in opposite directions with the two cores respectively.

There is also a connecting means associated with the first and second body members and adapted to electrically connect each of the first and second conductors to the respective core of a second electrical cable.

Preferably, the first and second body members are connected together for pivotal movement and are pivotable from the open position to the closed position.

More preferably, the first and second body members are distinct parts and are connected together by a hinge connection.

More preferably, the first and second body members are integral parts and integrally connected together by a resiliently deformable intermediate part.

It is preferable that the body can have a looped configuration when the first and second body members are in the closed position.

It is preferred that the body includes a locking device for locking the first and second body members in the closed position against a resiliently biasing force which resiliently biases the first and second body members towards the open position.

It is preferred that the locking device comprises a releasable latch for latching to lock the first and second body members in the closed position, the latch including a releasing part for deformation to release the latch.

Preferably, the gap is formed between two opposed gap parts provided by at least one of the first and second body members.

More preferably, the gap parts are provided by both the first and second body members, one gap part from each body member.

More preferably, the gap parts are both provided by the second body member.

In a preferred embodiment, the at last one of the gap parts has an inner surface which is resiliently movable to adjust the width of the gap.

More preferably, the inner surface of the at least one of the gap parts is provided by a resiliently flexible plate.

It is further preferred that the resiliently flexible plate implements the at least one of the gap parts.

It is further preferred that the at least one of the gap parts is includes a wall on the associated body member and supporting the resiliently flexible plate, the wall and the resiliently flexible plate together implementing the at least one of the gap parts.

In a preferred embodiment, the connecting means comprises respective second ends of the first and second conductors protruding from the corresponding first and second body members and pointing in opposite directions along a second imaginary plane when the first and second body members are in the closed position, and a second gap equivalent to the first-mentioned gap, through which second gap to the second imaginary plane extends, for receiving and locating a section of two cores with insulation of the said second electrical cable on the same second imaginary plane when the first and second body members are moved to the closed position with the second ends of the first and second conductors simultaneously cutting through insulation and coming into electrical connection in opposite directions with the two cores respectively of said second electrical cable.

In another preferred embodiment, the connecting means can comprised respective second ends of the first and second conductors at the corresponding first and second body members, and a connecting device for connecting the respective core of the second electrical cable to the second of the at least one of the first and second conductors.

More preferably, the connecting device can comprise a movable member on one of the first and second body members and adjacent the second end of the associated first or second conductor, the moveable member having an engaging part adapted to engage the respective core of the second electrical cable and, upon movement of the movable member, to connect it to the second end of the associated first or second conductor.

Further more preferably, the movable member is in pivotal engagement with the one of the first and second body members for pivotal movement to connect the respective core of the second electrical cable to the second end of the associated first or second conductor.

Further more preferably, the engaging part has a hole or recess for receiving to engage the respective core of the second electrical cable.

Further more preferably, the connecting device can comprise a pair of the moveable members on the first and second body members respectively for connecting the cores of respective said second electrical cables or respective cores of a second electrical cable to the second ends of the first and second conductors respectively.

In a preferred construction, each end of at least one of the first and second conductors has a relatively sharp tip or edge for piercing through insulation and coming into electrical connection with the respective core.

Further objects and advantages of this invention will be apparent from the following detailed description of the presently preferred embodiments which are illustrated schematically in the accompanying drawings.

DESCRIPTION OF THE PREFERRED EMBODIMENTS

Figure 1:
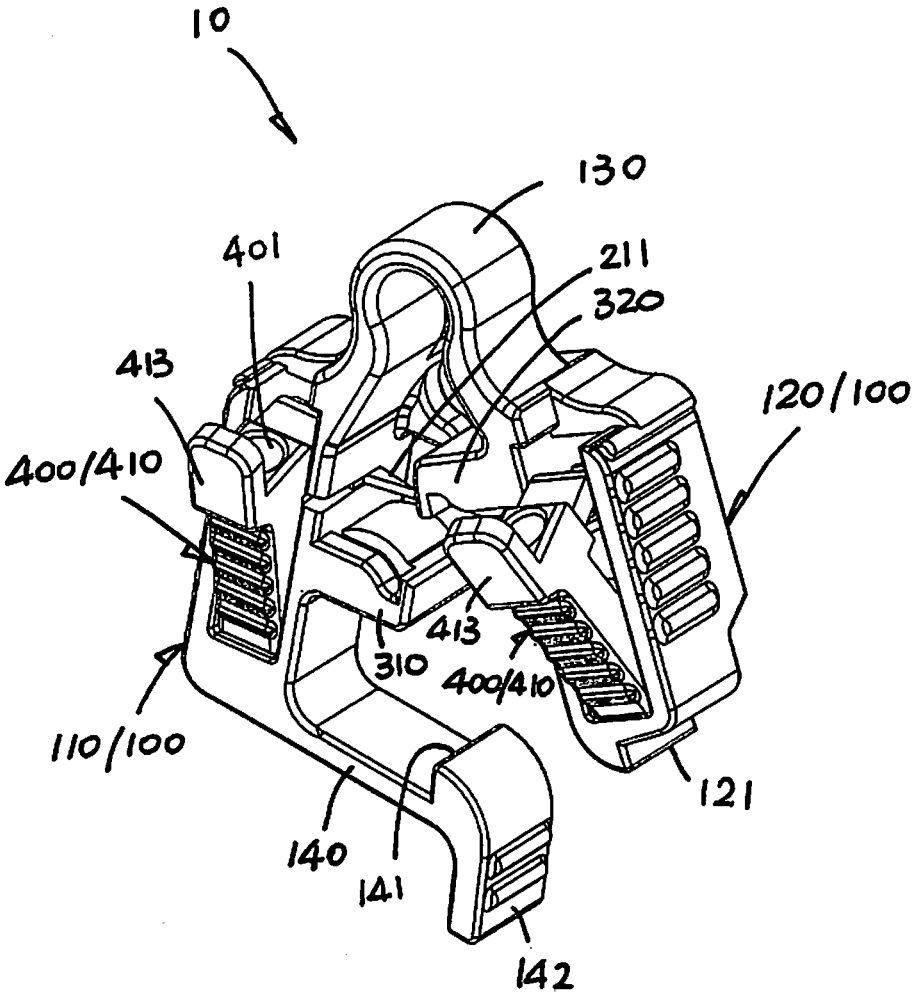
FIG. 1 is a front perspective view of a first embodiment of an electrical cable connector in accordance with the invention.
Figure 2:
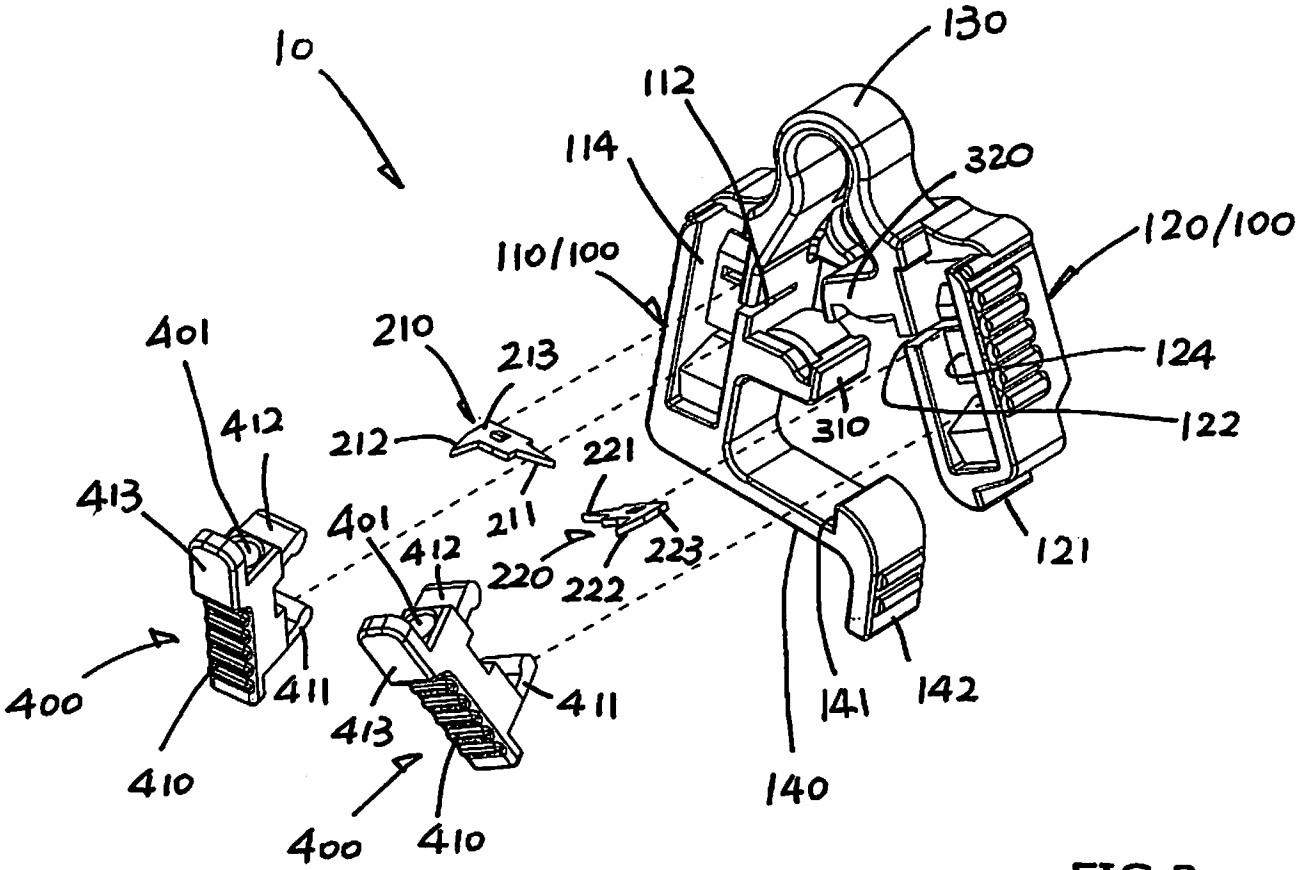
FIG. 2 is an exploded front perspective view of the electrical cable connector of FIG. 1, showing two electrical conductors therein.
Figure 3:
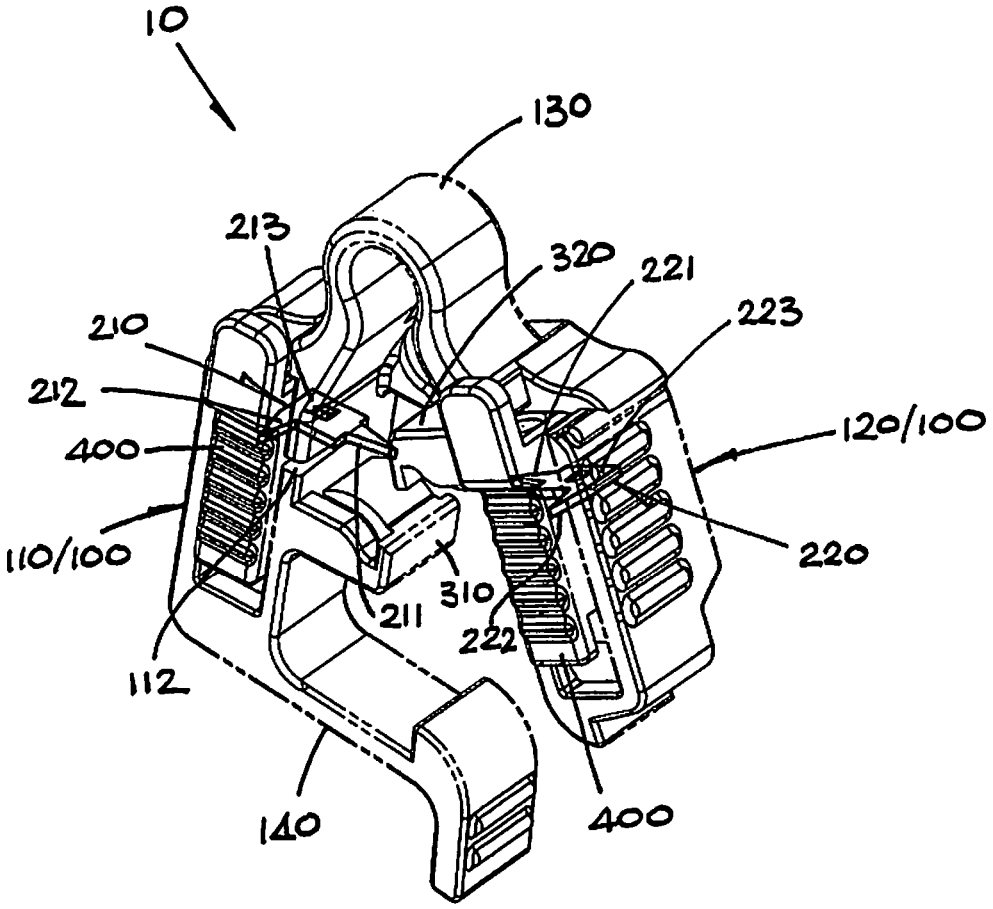
FIG. 3 is an assembled front perspective view of the electrical cable connector of FIG. 2, shown in a see-through view to reveal the two electrical conductors.
Figure 4:
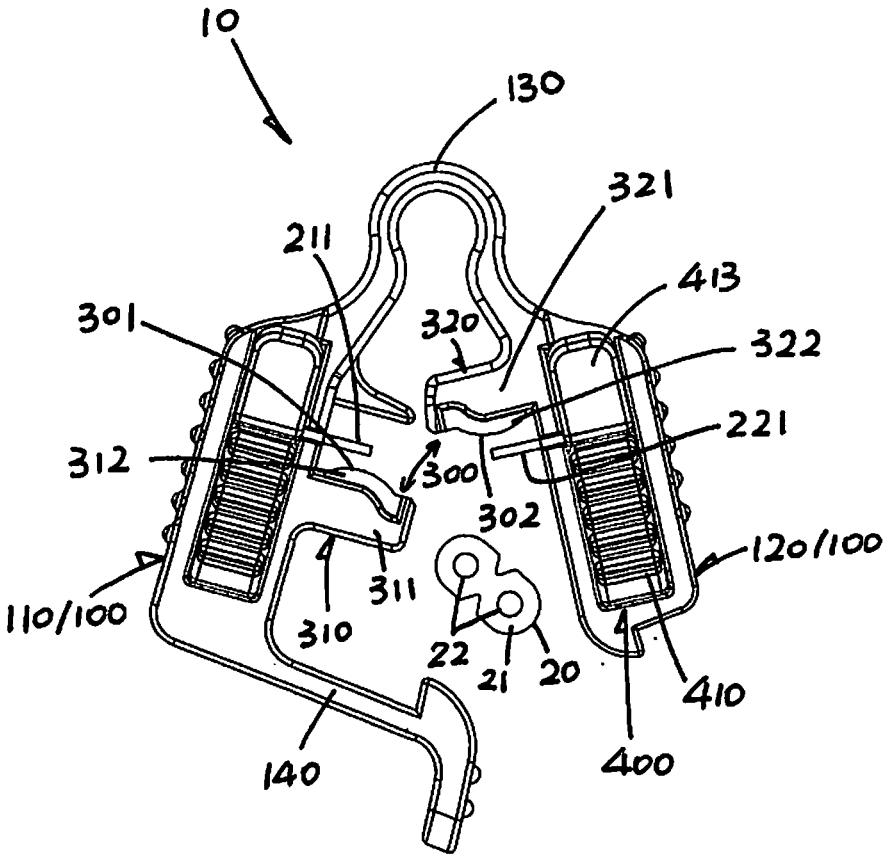
FIG. 4 is a front view of the electrical cable connector of FIG. 1, shown in an open condition and with an electrical cable connection thereby.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

A list of components will now be described.

10 Cable connector
10A second cable connector
10B third cable connector
20 power cable
21 insulating sheath
22 conductive core
30 fixture cable
31 insulating sheath
32 conductive core
100 connector body
100A second connector body
100B third connector body
110 oblong first body member/first leg
110A first body member/first leg
110B first body member/first leg
112 transverse slit
112A slit
114 rectangular recess
120 oblong second body member/second leg
120A second body member/second leg
120B second body member/second leg
121 step
122A slit
124 rectangular recess
130 band
130A integral band
130B hinge connection
131 keyhole-shaped aperture
140 lever
141 step
142 releasing tab
210 first conductor
210A first conductor
211 first end
211A first end
212A end
222 second end
213 plate
220 second conductor
220A second conductor
221 first end
221A first end
222 second end
222A end
223 plate
300 gap
300A gap
301/302 inner surfaces
310/320 gap parts
310A/320A gap parts
311/321 wall
311A wall
312/322 resiliently flexible plates
312A/312B pair of inwardly facing resiliently flexible convex plates
312B/312B pair of inwardly facing resiliently flexible convex plates
400 connecting device
401 recess or hole
410 oblong movable member
411 lower prong
412 upper prong
413 tab

First Embodiment

Referring to FIGS. 1-12B, an installer can use a one piece low voltage connector. The connector can have an upper first leg with a tab end and having a downwardly facing upper Main wire placement location (allows wire gauges 18-12) adjacent to a downwardly facing upper main brass connection pin for main wire. The end opposite the tab end can be attached by a hinge member to an end of a lower second leg having with an opposite end having a clip edge. The lower second leg can include an upper facing lower Main wire placement location (allows wire gauges 18-12), adjacent to a lower main brass connection pin for main wire. The outer surfaces of the legs can have grooves or raise edges to enhance gripping action The installer can place a main insulated wire conductor in the space between the facing main wire placement locations, and squeeze against the raised/grooved surfaces pressing the legs together and causing the facing pins to penetrate the insulated layer of the conductor. The legs can be locked together by the clip end of the lower leg catching against a clip portion on the tab end of the upper leg.

The installer can push ends of additional lead wires from other powered products such as landscape/pathway lights into the open upper lead wire ports, and the open lower lead wire ports. Next the user can pivot the ports against the legs to close the ports establishing an electrical connection between the main wire conductor and the lead wires.

Referring to FIGS. 1-12B, an electrical connector 10 can be used with a landscape lighting system upon an electrical cable 20, which is connected to a 12V DC (direct current) or AC (alternating current) power source, for drawing electrical power therefrom to operate a lighting fixture in a garden or the like, e.g. a garden light, via an individual electrical cable 30 connected to the garden light. The cable connector 10 can serve to electrically connect the fixture cable 30 to the power cable 20. Each cable 20/30 typically can have a pair of conductive cores 22/32 protected by insulation, such as an insulation sheath 21/31.

The cable connector 10 can have a body 100, molded from plastics material for example, and first and second conductors 210 and 220, made of copper material for example, supported by the connector body 100 for establishing electrical connection between the power and fixture cables 20 and 30.

Figure 6:
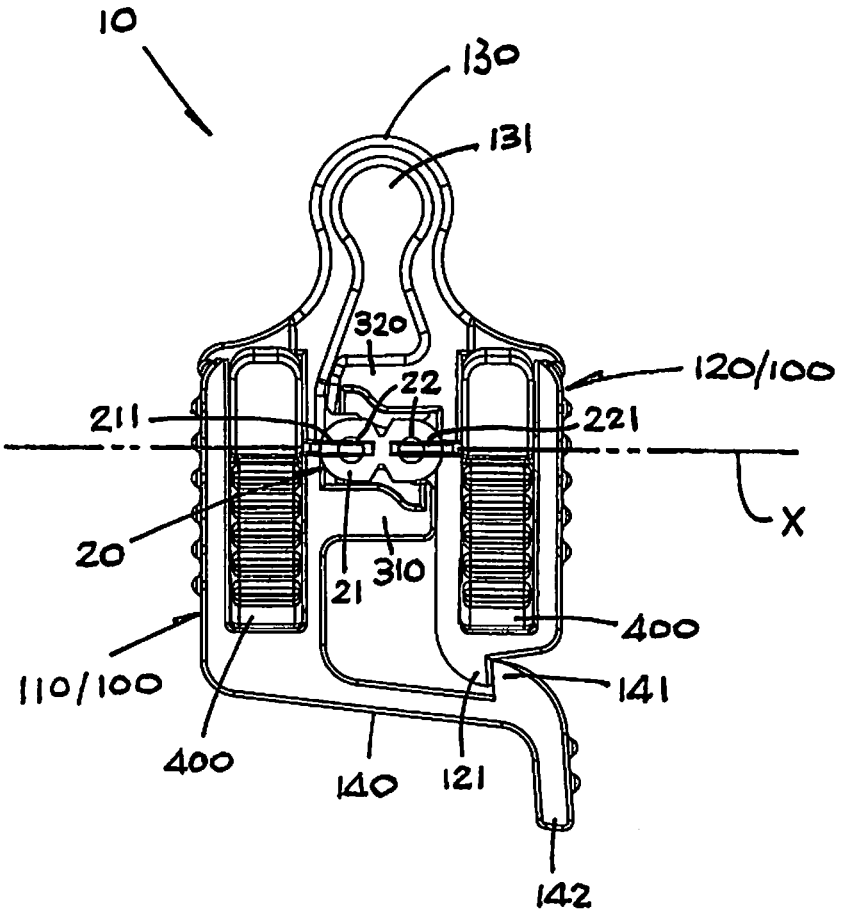
FIG. 6 is a front view of the electrical cable connector subsequent to FIG. 5, shown in a closed condition and with the electrical cable connected.
Figure 7:
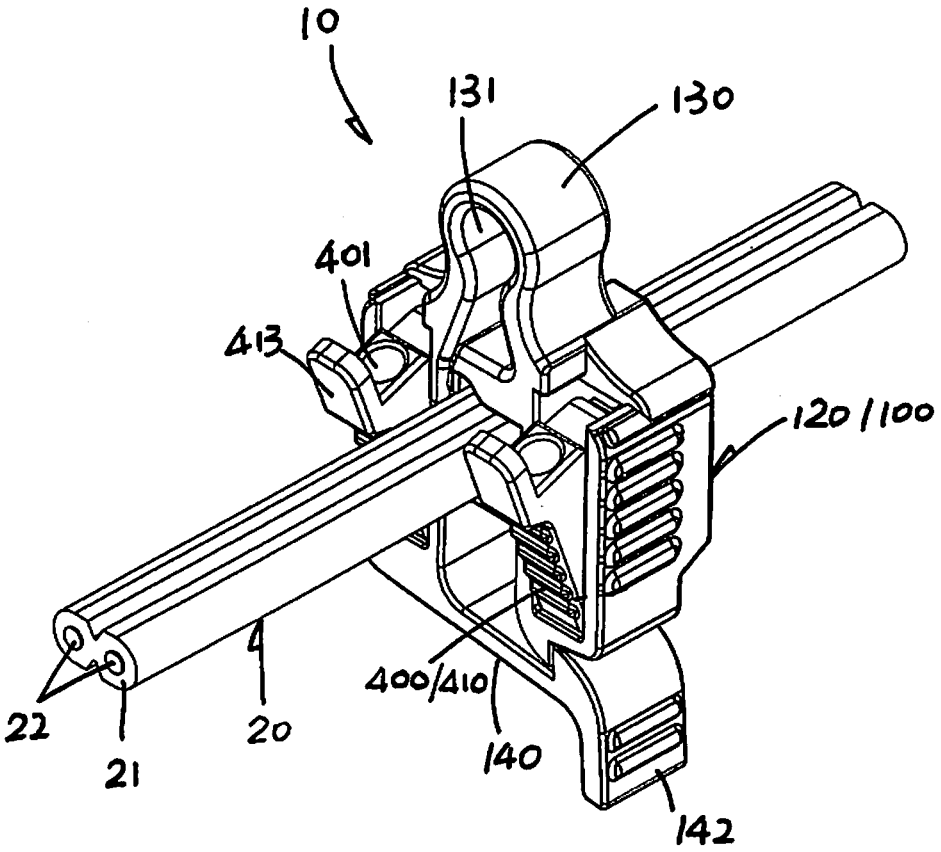
FIG. 7 is a front perspective view of the electrical cable connector of FIG. 6.
Figure 8:
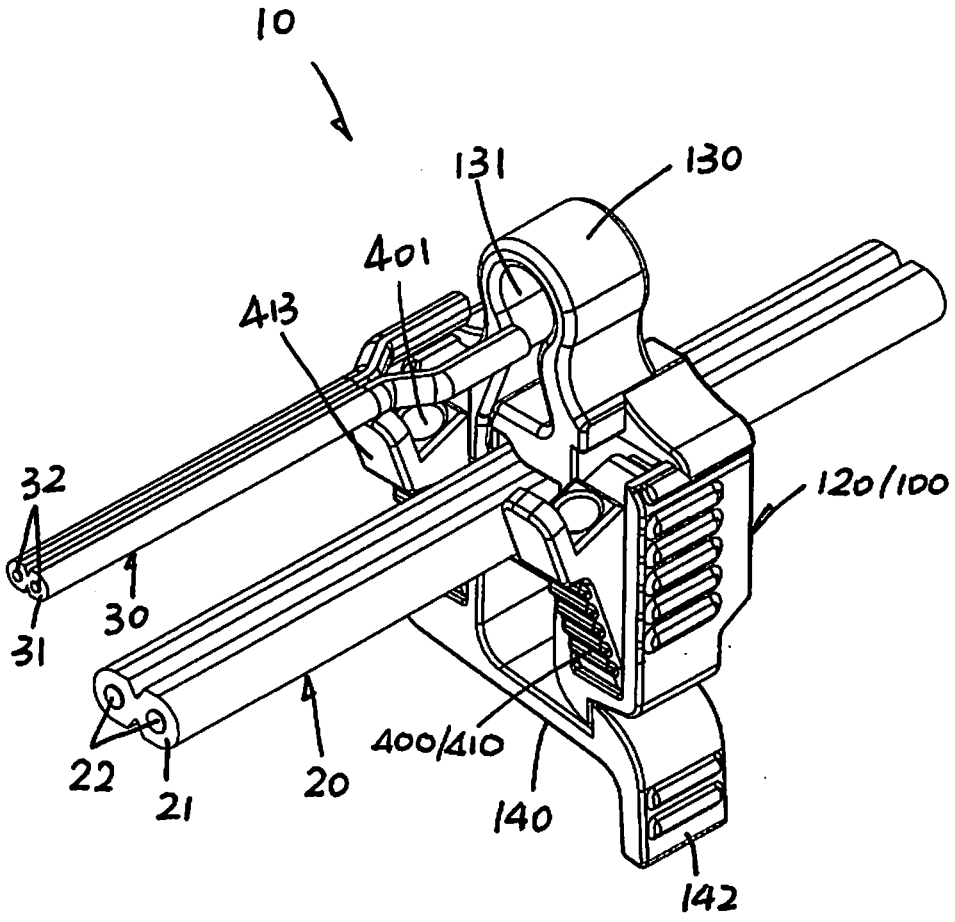
FIG. 8 is a front perspective view of the electrical cable connector of FIG. 7, with a second electrical cable for connection thereby.

The cable connector body 100 can include an oblong first body member 110 and an oblong second body member 120 which are connected together and are movable, and preferably pivotable, from an open position in which the first and second body members 110 and 120 are relatively spaced apart (FIG. 4) to a closed position in which the first and second body members 110 and 120 are relatively close together (FIG. 6). The two body members 110 and 120 are integrally connected together, at respective near or connected ends, by a resiliently deformable intermediate part in the form of a relatively thin band 130 which permits flexing or pivotal movement, in opposite directions, of the body members 110 and 120 between the open and the closed positions.

The band 130 is resiliently deformable and is shaped such that the two body members 110 and 120 are held by the band 130 (having a memory) to stay normally or at rest in the open position and are upon compression pivotable to the closed position against the resiliently biasing action of the band 130.

The first body member 110 acts at its free end, as opposed to the connected end, an integral lever 140 which extends transversely to reach the free end of the second body member 120. At the free end of the lever 140 and that of the second body member 120, there are formed respective steps 141 and 121 which face in opposite directions for inter-engagement through a snap action, as permitted through slight flexing of the lever 140, when the body members 110 and 120 are pivoted to reach the closed position.

The lever 140 acts as a locking device designed to lock the first and second body members 110 and 120 in the closed position against the resiliently biasing force imparted by the band 130, which resiliently biases the first and second body members 110 and 120 apart from one another towards the open position. This locking device takes the form of a releasable latch for latching, by way of inter-engagement between the associated steps 141 and 121 through a snap action, to lock the first and second body members 110 and 120 in the closed position.

This results in a locked condition, with the two body members 110 and 120 in the closed position, in which the overall connector body 100 is completely closed as between the body members 110 and 120 by the lever 140 to form a looped configuration. The band 130 is restricted to form a keyhole-shaped aperture 131.

The latch is releasable and, for this purpose, includes a releasing tab 142 provided right at the free end of the lever 140 for pressing to deform or bend the lever 140 slightly outward so as to release the latch through disengagement of the lever's step 141 from the body member's step 121. Whereupon the body members 110 and 120 are instantly sprung open, therefore back to the open position. Such quick release or unlocking is a convenient attribute of the latch.

Referring to the first and second conductors 210 and 220, they are supported by the first and second body members 110 and 120 respectively. In each case, the conductor 210/220 has a generally flat profile, having a plate 213/223 with two first and second ends 211/221 and 212/222 projecting outwardly in mutually perpendicular directions. Each end 211/221/212/222 can have a relatively sharp tip (or edge) for piercing through insulation 21/31 and coming into electrical connection with the respective core 22/32, as hereinafter described.

The first conductor 210 can be inserted with its plate 213 in a transverse slit 112 in the first body member 110, with its first end 211 protruding and pointing generally at the second body member 120 and its second end 212 pointing to the front side of the connector body 100. Similarly, the second conductor 220 is inserted with its plate 223 in a transverse slit 122 in the second body member 120, with its first end 221 protruding and pointing generally at the first body member 110 and its second end 222 pointing also to the front side of the connector body 100.

More specifically, with the first and second body members 110 and 1220 in the closed position, the two first ends 211 and 221 of the conductors 210 and 220 point in opposite directions right at each other and, in particular along an imaginary plane X (as shown in FIG. 6).

The power cable 20 is intended to be located with a section of its two cores 22 extending through the connector body 100 and lying on the same imaginary plane X, when the first and second body members 110 and 120 are pivoted to the closed position, for electrical connection by the first ends 211 and 221 of the two conductors 210 and 220 respectively. Locating the cable section 20 in such a position involves the use of a gap 300 which is associated with both (or at least one) of the first and second body members 110 and 120, through which gap 300 the imaginary plane X extends.

The gap 300 can be formed by and between a pair of opposed gap parts 310 and 320 which are provided by both (or at least one) of the first and second body members 110 and 120, one gap part 310/320 from each body member 110/120. The gap parts 310 and 320 can have respective inner surfaces 301 and 302 which are resiliently movable to adjust, either increasing or reducing, the width of the gap 300. Each inner surface 301/302 can be provided by a resiliently flexible plate 312/322 which alone can implement the respective gap part 310/320 (see second embodiment), or in conjunction with a wall 311/321 on the associated body member 110/120 as in the present embodiment.

More specifically, each gap part 310/320 can include the wall 311/321 that supports the corresponding resiliently flexible plate 312/322, together implementing the gap part 310/320. The resiliently flexible plate 312/322, which is an integral part of the wall 311/312, extends downward from the upper end of the wall 311/321 and overlaps with the wall 311/321 but is spaced apart therefrom at a small yet adequate distance.

Figure 5:
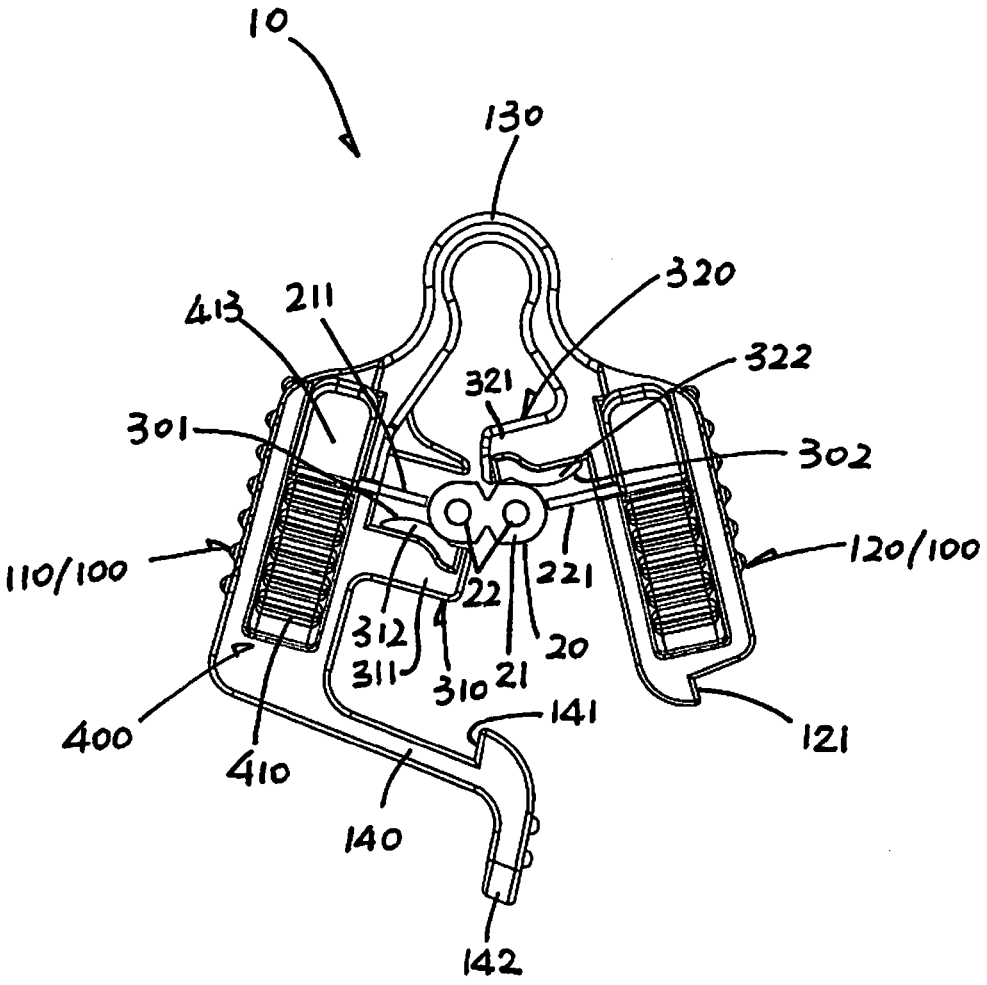
FIG. 5 is a front view of the electrical cable connector subsequent to FIG. 4, showing the electrical cable being connected.

In operation, while the cable connector 10 is open, the power cable 20 is inserted laterally into the space between the first and second body members 110 and 120 (FIG. 4) and in particular the space right between the first ends 211 and 221 of the conductor 210 and 220 (FIG. 5). Upon the first and second body members 110 and 120 being pivoted to the closed position, the conductors' first ends 211 and 221 simultaneously cut or pierce through the insulation 21 and come into electrical connection in opposite directions with the two cable cores 22 respectively, with the lever 140 finally and automatically latching the body members 110 and 120 in the closed position and hence the cable connector 10 firmly closed (FIG. 6). Cable connection can be made as a simple and a quick operation.

As the body members 110 and 120 are pivoting together, the gap parts 310 and 320 thereon are simultaneously brought closer together to form the gap 300 locating the relevant section of the power cable 20 and hence its cores in alignment, along the imaginary plane X, with the respective conductor ends 211 and 221 for electrically connection thereby through the insulation 21.

The resiliently flexible plates 312 and 322 on opposite sides in the gap 300 can be flexed slightly inwards by the cable 20 to self-adjust the width of the gap 300 for accommodating the cable 20 of a size or thickness in the upper part of a range for which the cable connector 10 is designed. Hence, the cable connector 10 is fit for use with cables of an extended range of thickness/size.

For electrical connection to the garden light, the cable connector 10 can include a connecting means associated with the first and second body members 110 and 120 and adapted to electrically connect each of the first and second conductors 210 and 220 to the or a respective core of the fixture cable 30.

The connecting can be implemented by the second ends 212 and 222 of the first and second conductors 210 and 220 at the corresponding first and second body members 110 and 120, and includes a pair of identical connecting devices 400 each for connecting a respective core 32 of the fixture cable 30 to the second end 212/222 of the corresponding conductor 110/120. Each connecting device 400 can be implemented by an oblong movable member 410 mounted partially in a rectangular recess 114/124 on the associated body member 110/120 and adjacent the second end 212/222 of the related conductor 210/220.

Each moveable member 410 can have an engaging part in the form of a recess or hole 401 adapted to receive and engage the end of a respective core 32 of the fixture cable 30. The movable member 410 includes a lower prong 411 pivotally engaged or hinged within the lower end of the body member recess 114/124 such that the movable member 410 is pivotable into or out of the recess 114/124, and an upper prong 412 for snapping within the upper end of the recess 114/124 to lock the movable member 410 inside the recess 114/124. A tab 413 at the top of the movable member 410 can be pressed to unlock and pivot the movable member 410 out from the recess 114/124, thereby exposing the hole 401 for insertion (or withdrawal) of the end of the cable core 32.

Figure 9:
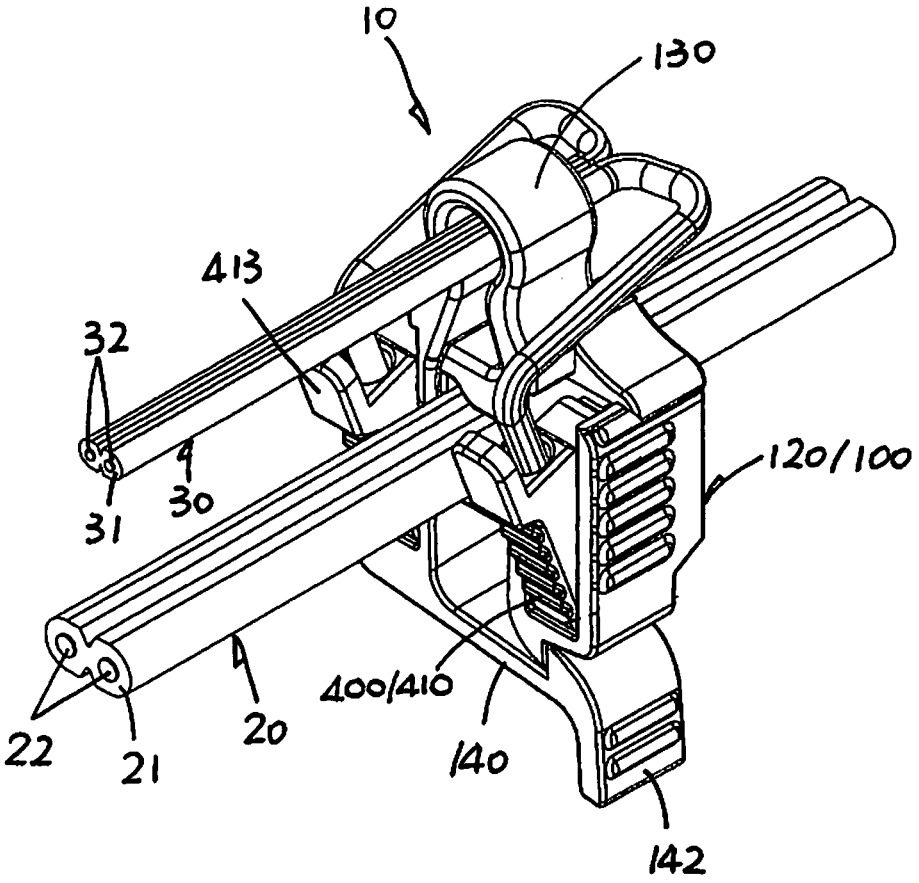
FIG. 9 is a front perspective view of the electrical cable connector subsequent to FIG. 8, showing the second electrical cable being connected.
Figure 10:
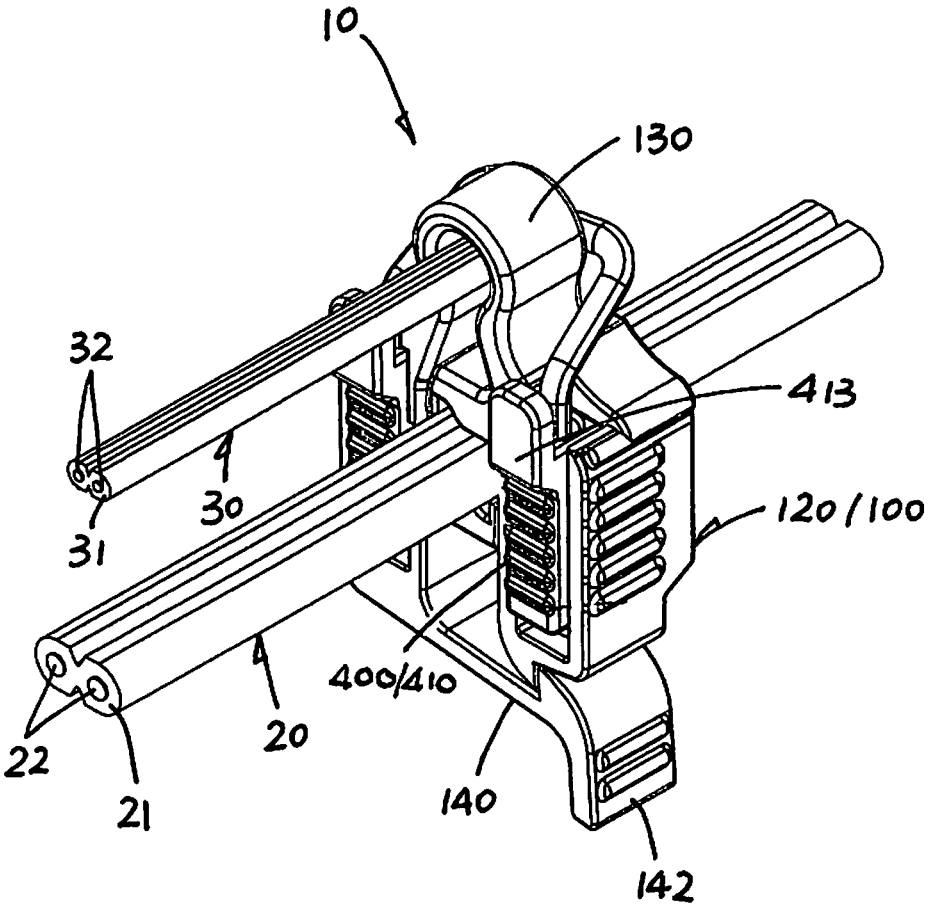
FIG. 10 is a front view of the electrical cable connector subsequent to FIG. 9, showing the second electrical cable connected.
Figure 11A:
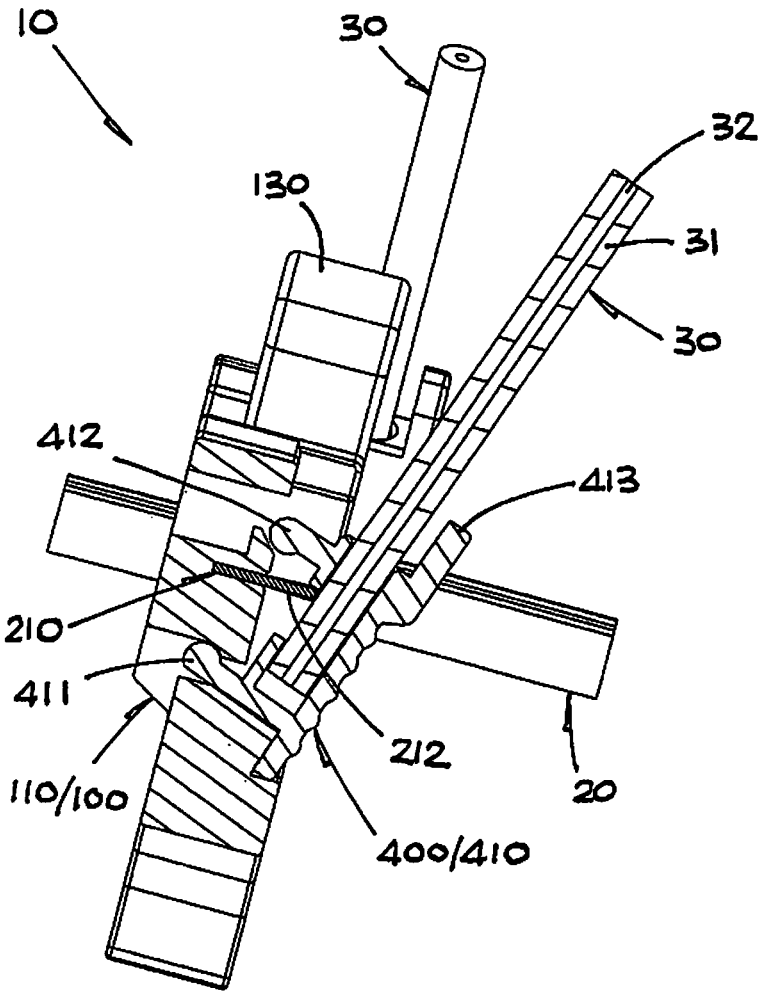
FIGS. 11A and 11B are cross-sectional views of the electrical cable connector, showing connection of the second electrical cable in conditions corresponding to those of FIGS. 9 and 10, respectively.
Figure 11B:
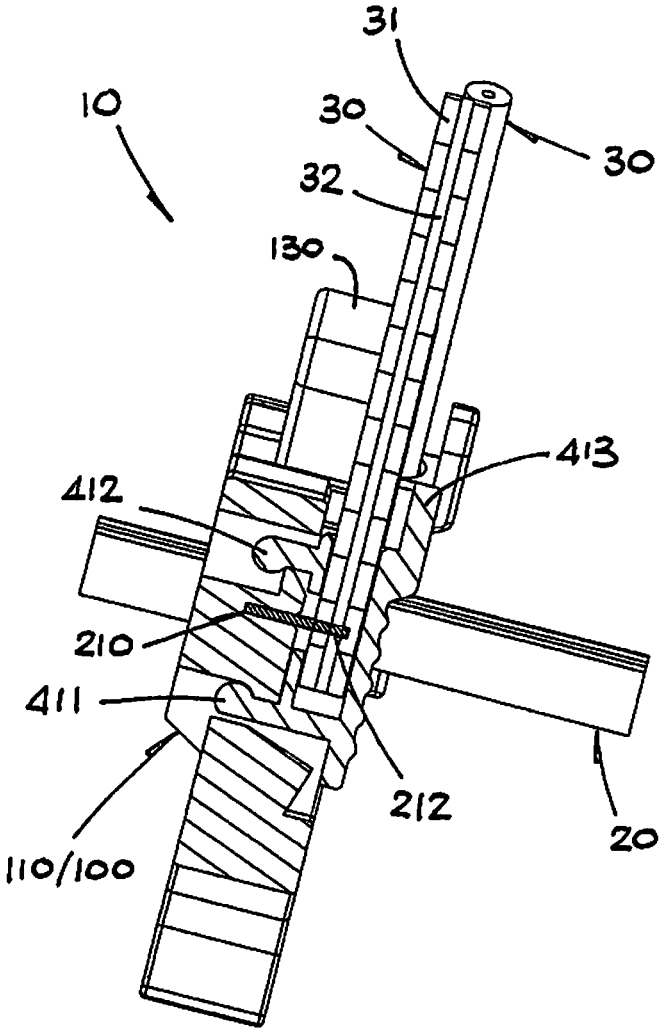
Figure 12A:
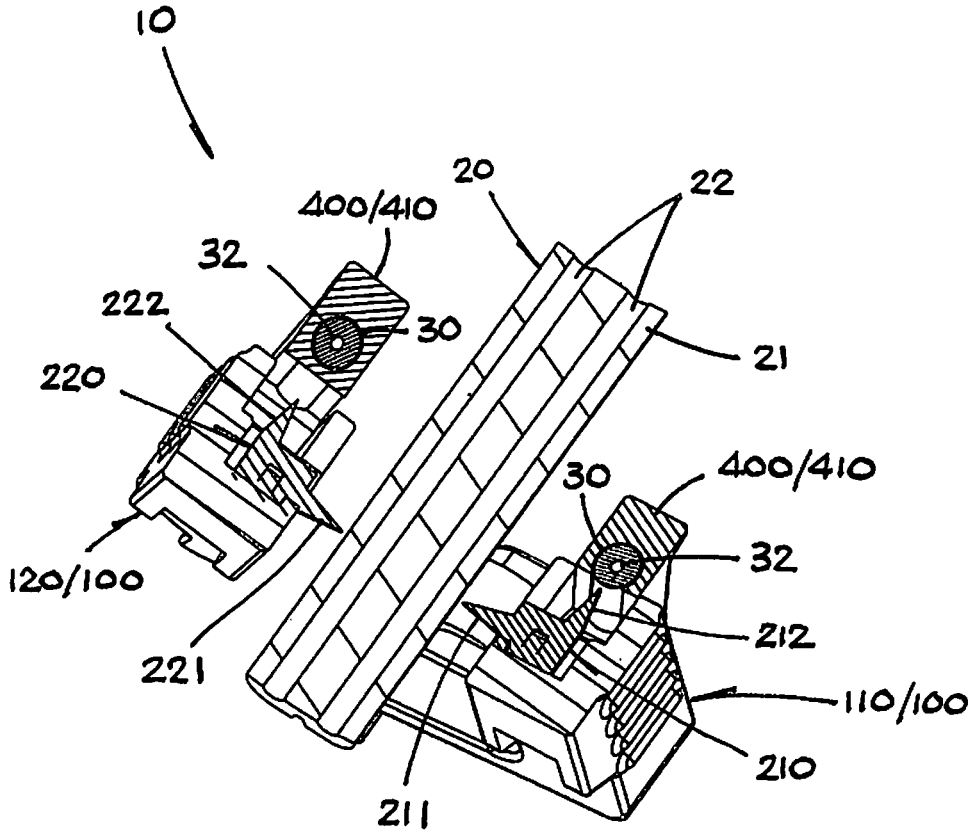
FIGS. 12A and 12B are cross-sectional views of the electrical cable connector, showing connection of the second electrical cable in stages sequentially from FIGS. 9-10.
Figure 12B:
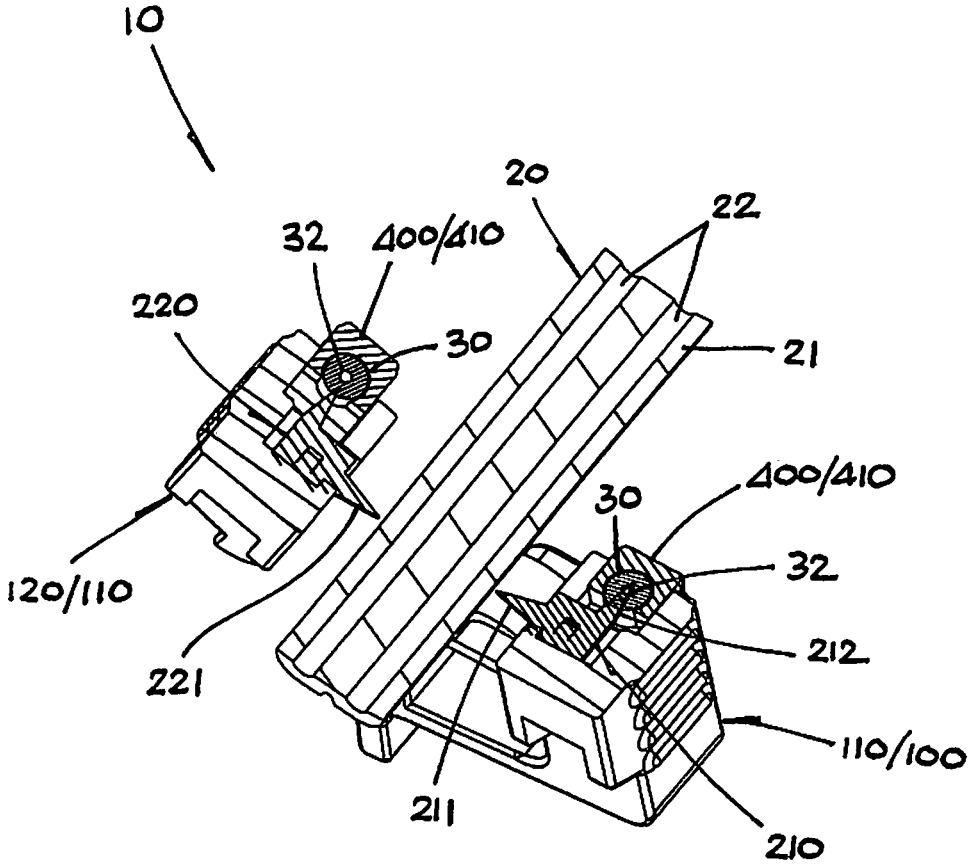

In operation of each connecting device 400, while the movable member 410 is in the outer position, the fixture cable core 32 is inserted with its end fully into the hole 401 (FIG. 9). The movable member 410 is then pivoted into the recess 114/124 (FIG. 10), whereupon the moveable member 410 brings the cable core end close to and pushes it against the second end 212/222 of the corresponding first/second conductor 110/120, with the conductor end 212/222 simultaneously cutting or piercing through the insulation 31 and coming into electrical connection with the cable core 32 (FIGS. 11A-11B), until the movable member 410 is fully pushed into the recess 114/124 and firmly locked therein To reinforce the attachment of the fixture cable 30 to the cable connector 10, the fixture cable 30 can first be threaded through the keyhole-shaped aperture 131 provided by the band 130 (FIG. 8) before its cores 32 are electrically connected as described above.

Second Embodiment

Figure 13:
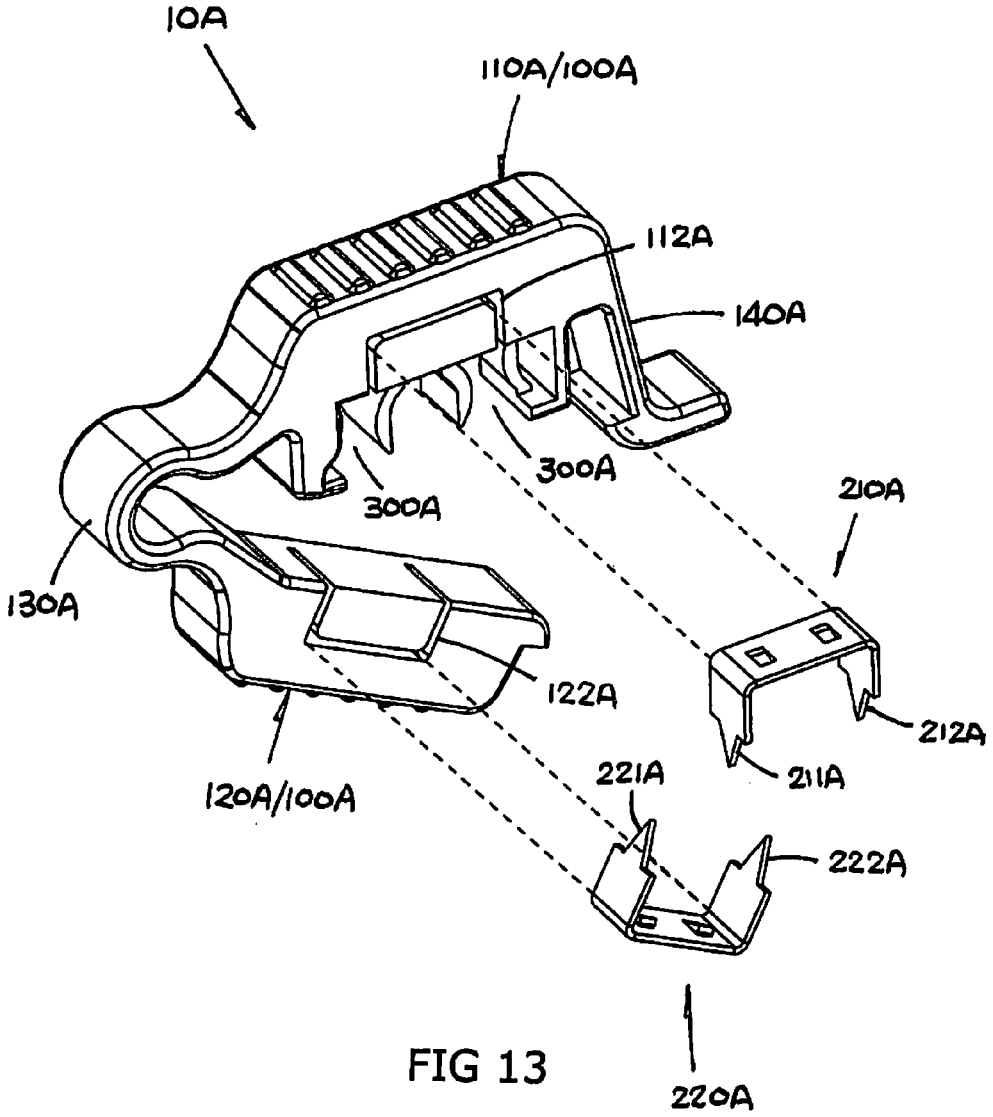
FIG. 13 is a front perspective view of a second embodiment of an electrical cable connector in accordance with the invention.
Figure 14:
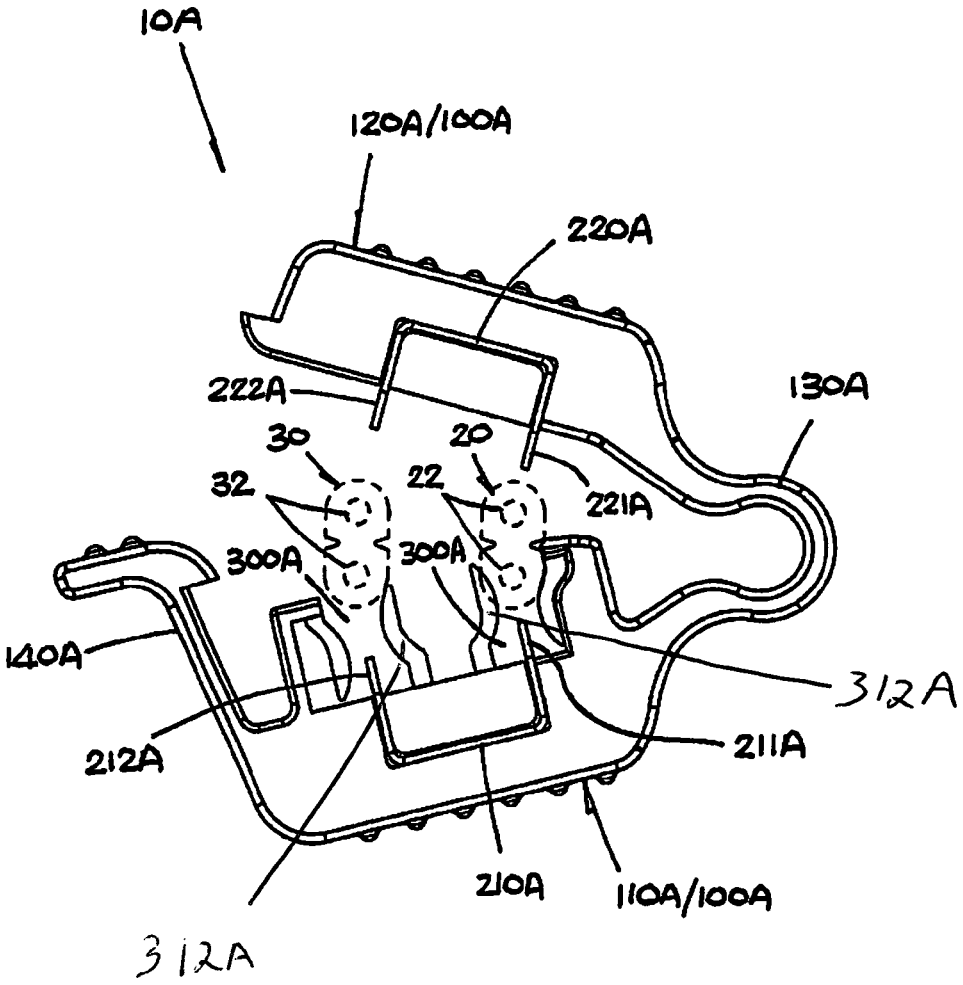
FIG. 14 is a front view of the electrical cable connector of FIG. 13, shown in an open condition and with two electrical cables for connection thereby.
Figure 15:
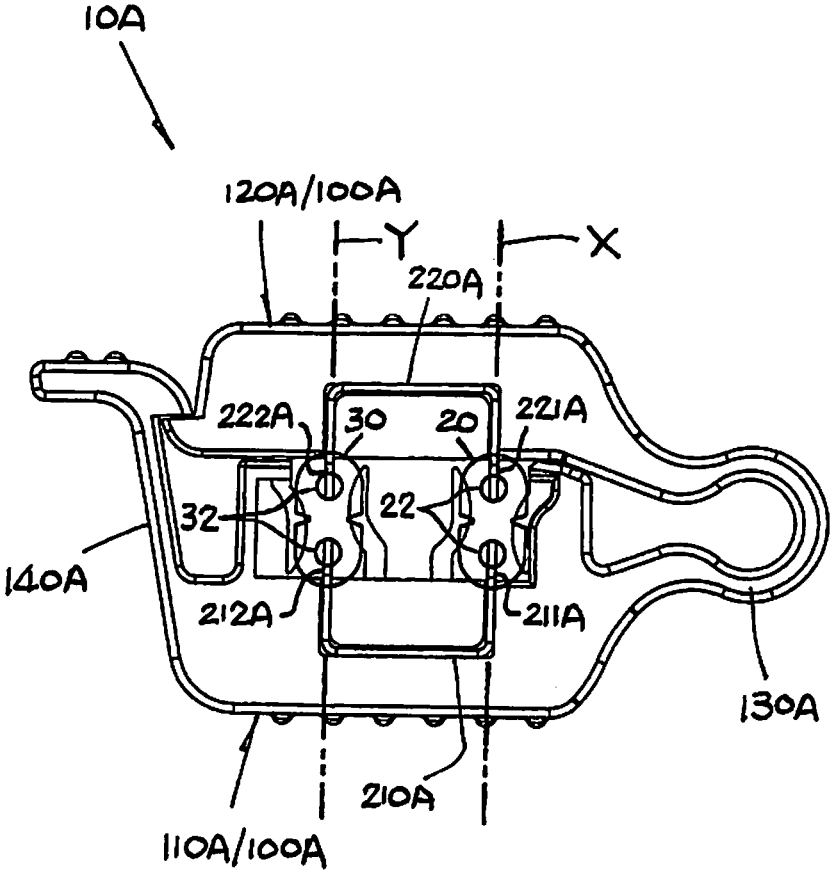
FIG. 15 is a front view of the electrical cable connector subsequent to FIG. 14, shown in a closed condition and with the two electrical cables connected.

Referring to FIGS. 13-15, a second embodiment of the electrical connector 10A is shown, which has a similar construction as the first embodiment above, with equivalent parts designated by the same reference numerals suffixed by the letter "A".

In the second cable connector 10A, the connector body 100A is likewise formed by a pair of first and second body members 110A and 120A which are interconnected by an integral band 130A, support respective conductors 210A and 220A, and includes a gap 300A for connecting the power cable 20 in generally in the same manner as previously described. There is a minor difference in that the two gap parts 310A and 320A forming the gap 300A can be provided by only one of the body members 110A and 120A, i.e. the second body member 120A, such that the gap 300A is always present and ready for use even when the connector body 100A is in the open condition.

As a major difference in this cable connector 10A, the previous connecting devices 400/moveable members 410 and related recesses 114/124 on the body members have been omitted and are replaced by a different connecting means. Although the fixture cable 30 is connected differently, it is now connected in the same manner as the power cable 20, and simultaneously in a unitary operation, thereby making quick cable connection possible. To achieve this, there is provided a second gap 300A associated with the body members 110A and 120A for connecting the fixture cable 30, of the same construction as and provided next to the first gap 300A.

The two gaps 300A do not share the same construction with the previous gap 300. In the present case, each gap 300A is formed between a pair of opposed gap parts 310A and 320A which are both formed on the second body member 120A. Thus, the two pairs of gap parts 310A and 320A both protrude from the inner side of the second body member 120A. There is also another change, in that whilst one gap part 310A is likewise provided by a wall 311A with an integrally-connected resiliently flexible plate 312A, the other gap part 320A is implemented only by a resiliently flexible plate 322A alone, which protrudes directly from the associated body member 120A.

In any event, both of the gaps 300A can be made to keep the function of self-adjusting their gap width to accommodate cable of an extended range of thickness/size, for connection of power cables as well as fixture cables.

The two gaps 300A for connecting respective cables 20 and 30 are arranged side-by-side, and this warrants a similar arrangement as between opposite ends 211A/221A and 212A/222A of the first and second conductors 210A and 220A. More specifically, each conductor 210A/220A is now made from a rectangular U-shaped strip and is located in a corresponding slit 112A/122A of a matching shape in the respective first/second body member 110A/120A. The slit 112A/122A is flatter (i.e. having shorter legs) so as to expose opposite ends 211A/221A and 212A/222A of the conductor 210A/220A, which in turn protrude in the same direction from the associated body member 110A/120A and point at or towards the respective gaps 300A.

Generally stated, the connecting parts for connecting the fixture cable 30 includes respective second ends 212A and 222A of the tow conductors 210A and 220A protruding from the corresponding first and second body members 110A and

120A and pointing in opposite directions along a second imaginary plane Y when the body members 110A and 120A are in the closed position. Also, included is a second gap 300A, of identical construction as the first-mentioned gap 300A for the power cable 20, through which second gap 300A a second imaginary plane Y (parallel to the first imaginary plane X) extends, for receiving and locating a section of two cores 32 with insulation of the fixture cable 30 on the same second imaginary plane Y when the body members 110A and 120A are pivoted to the closed position. As the body members 110A and 120A are being closed, the second ends 212A and 222A of the two conductors 210A and 220A will simultaneously cut through the insulation and come into electrical connection, in opposite directions, with the respective cable cores 32.

It is understood that the same operation as described in the preceding paragraph also applies to the connection of the power cable 20, and will take place simultaneously as the power and fixtures cables 20 and 30 are connected by the cable connector 10A (FIGS. 15-16) to complete the power supply circuit for the garden light.

Third Embodiment

Figure 16:
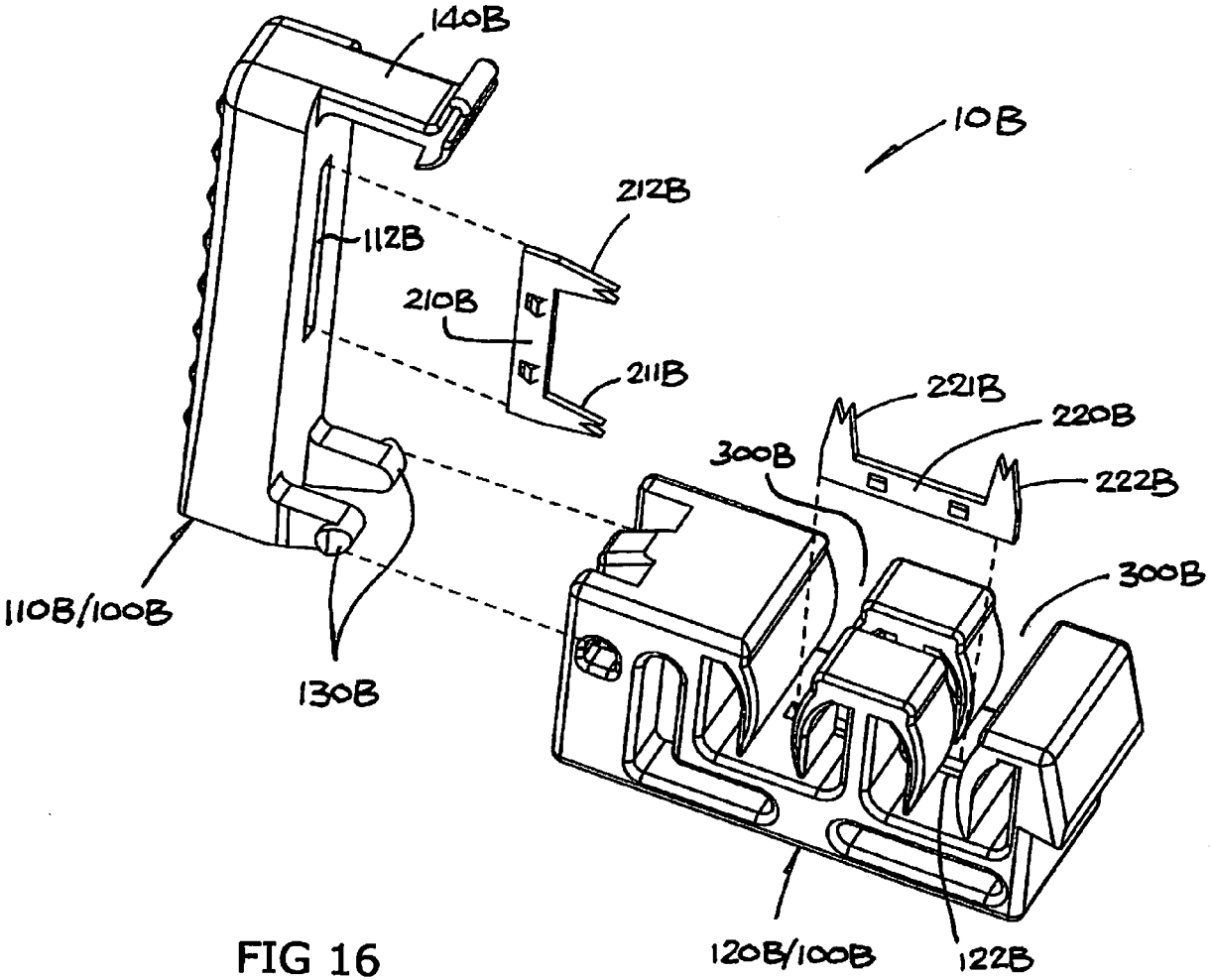
FIG. 16 is a front perspective view of a third embodiment of an electrical cable connector in accordance with the invention.
Figure 17:
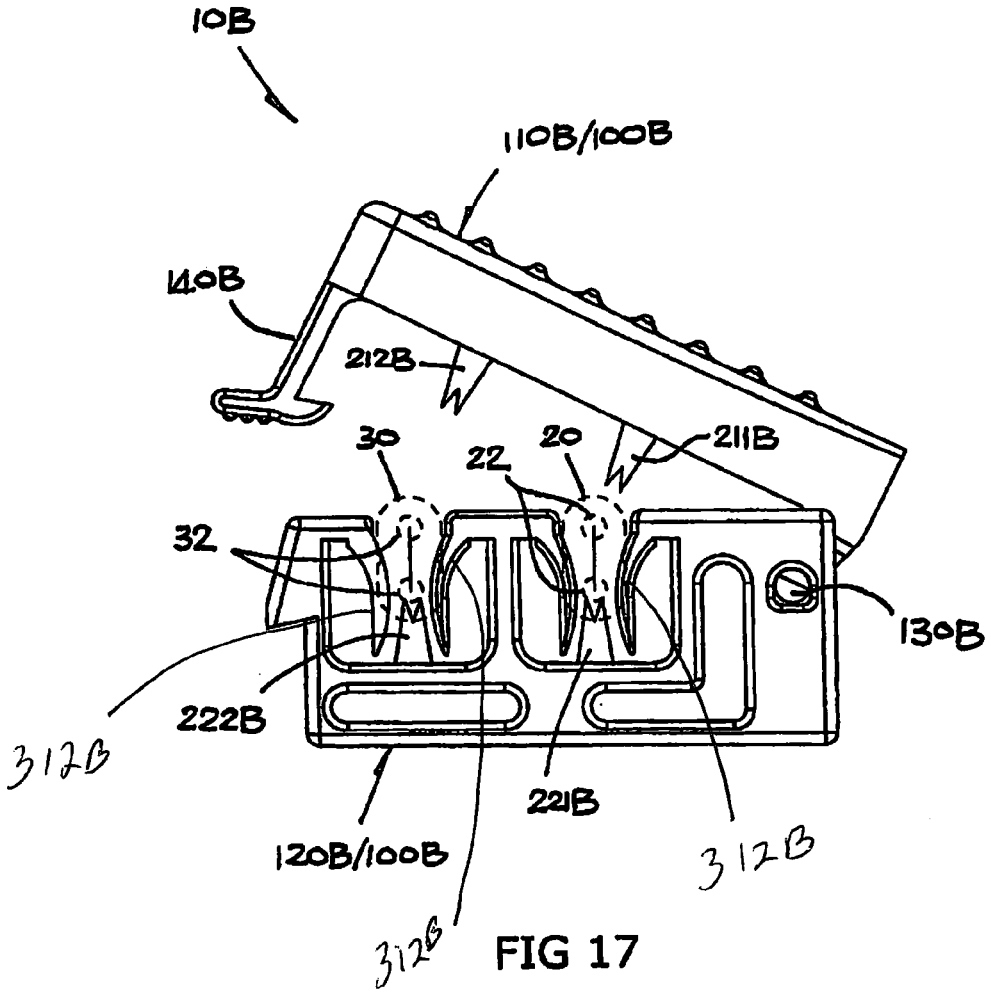
FIG. 17 is a front view of the electrical cable connector of FIG. 16, shown in an open condition and with two electrical cables for connection thereby.
Figure 18:
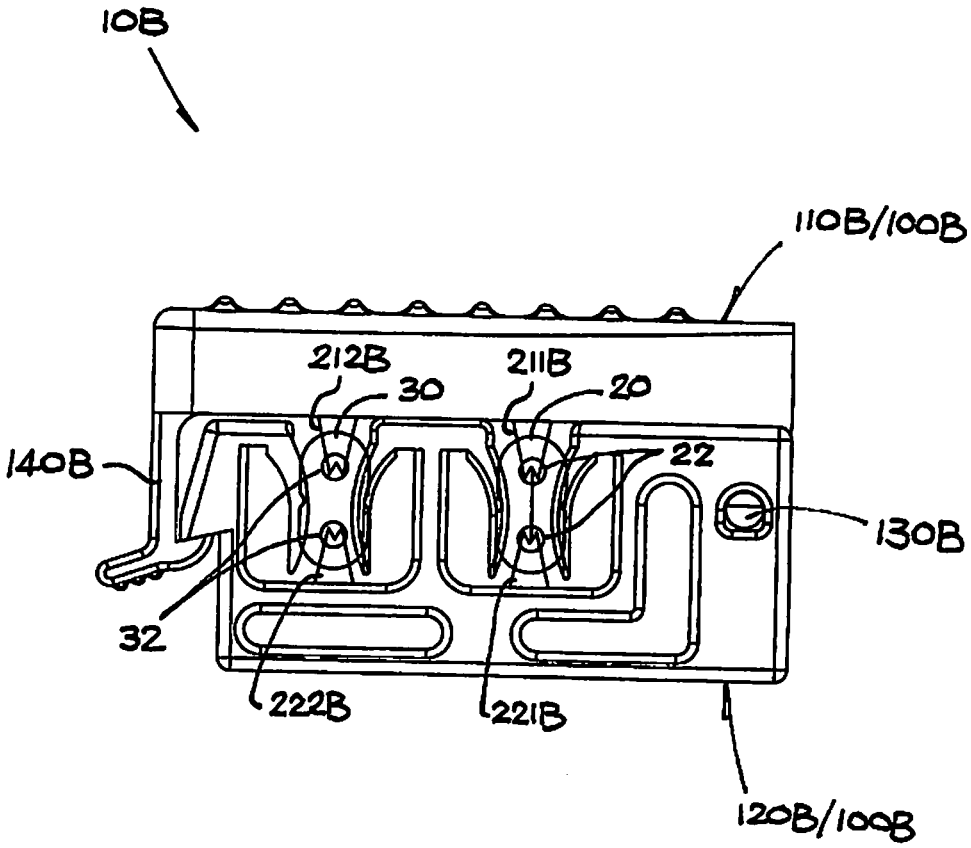
FIG. 18 is a front view of the electrical cable connector subsequent to FIG. 17, shown in a closed condition and with the two electrical cables connected.

Referring to FIGS. 16-18, a third embodiment of the electrical cable connector 10B can have a similar construction as the second electrical cable connector 10A described above unless otherwise stated, with equivalent parts designated by the same reference numerals suffixed by a letter "B" in place of "A".

The third cable connector 10B can be made relatively larger and physically stronger for heavier duty tasks, e.g. use on thicker cables. A difference can be in the connector body 100B being formed by a pair of distinct (i.e. separate) first and second body members 110B and 120B which are connected together by means of a hinge connection 130B (e.g. hinge pin or equivalent structure). The hinge connection 130B permits a wider opening between the body members 110B and 120B.

As shown in the drawings and described above, the subject electrical cable connector can have a minimal construction and is simple and quick to use. It is also capable of self-adjustment, and without use of any tool, to allow for connection of cables of an extended range of thickness/size.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An electrical wire connector comprising:

a first leg having a free end and a second end;

a second leg having a free end and a second end;

a hinge for attaching the second end of the first leg to the second end of the second leg, the first leg and the second leg allowing for a first gap formed between a first pair of resilient walls and a second gap formed between a second pair of resilient walls, with the first gap spaced apart from the second gap;

a pair of opposite facing first conductive penetrators on the first leg and the second leg that move against one another into the first gap when the free end of the first leg and the free end of the second leg are moved toward one another, wherein a first insulated cable covering two side by side wire conductors placed in the first gap between the first leg and the second leg is penetrated by the first conductive penetrators without having to remove insulation from the first insulated cable covering the two side by side wire conductors; and a pair of opposite facing second conductive penetrators on the first leg and the second leg that move against one another into the second gap when the free end of the first leg and the free end of the second leg are moved toward one another, wherein a second insulated cable covering two side by side wire conductors placed in the second gap between the first leg and the second leg is penetrated by the second conductive penetrators without having to remove insulation from the second insulated cable covering the two side by side wire conductors, wherein the first and second conductive penetrators form an electrical connection when pressed into the first and the second insulated wire conductors.

2. The electrical wire connector of claim 1, wherein the pair of opposite facing first conductor penetrators and the pair of opposite facing second conductor penetrators include: pins.

3. The electrical wire connector of claim 1, further comprising:

ridge surfaces on the first leg and the second leg for enhancing gripping with the connector.

4. The electrical wire connector of claim 1, wherein the free end of the first leg and the free end of the second leg include a clip edge for allowing the free end of the first leg and the free end of the second leg to lock together.

5. The electrical wire connector of claim 1, the wherein the pair of opposite facing first conductor penetrators and the pair of opposite facing second conductor penetrators include:

a first rectangular U shaped conductor in the first leg; and a second rectangular U shaped conductor in the second leg.

6. The electrical wire connector of claim 1, wherein both the first gap and the second gap are each formed between a pair of inwardly facing resiliently flexible convex plates.

7. An electrical cable connector for electrically connecting a first electrical cable to a second electrical cable, each cable having insulation, comprising:

a body having a first elongated body member and a second elongated body member which are pivotally hinged together and are moveable from an open position in which the first and second elongated body members are relatively spaced apart to a closed position in which the first and second elongated body members are relatively close together;

a first insulated cable covering a pair of conductors supported in a first gap by the first elongated body member and the second elongated body member, the first gap having a first pair of opposite facing conductor penetrators; and a second insulated cable covering a pair of conductors supported in a second gap by the first elongated body member and the second elongated body member, the second gap having a second pair of opposite facing conductor penetrators, wherein the first and second elongated body members are moved to the closed position with ends of the first pair of conductor penetrators and the second pair of conductor penetrators cutting through insulation in the first insulated cable and cutting through insulation in the second insulated cable, and forming an electrical connection between the first insulated cable and the second insulated cable.

8. The electrical cable connector of claim 7, wherein the first and second elongated body members are integral parts and are integrally connected together by a resiliently deformable intermediate part.

9. The electrical cable connector of claim 7, wherein the body includes a locking device for locking the first and second elongated body members in the closed position against a resiliently biasing force which resiliently biases the first and second body members towards the open position.

10. The electrical cable connector of claim 9, wherein the locking device comprises a releasable latch for latching to lock the first and second elongated body members in the closed position, the latch including a releasing part for deformation to release the latch.

11. The electrical cable connector of claim 7, wherein the first gap and the second gap each include a pair of resilient wall members.

12. The electrical cable connector of claim 7, wherein the first gap and the second gap are in the first body member.

13. The electrical cable connector of claim 7, wherein the first gap and the second gap are in the second body member.

14. The electrical cable connector of claim 7, wherein the first gap is formed between a pair of concave curved inwardly facing resiliently flexible plates.

15. The electrical cable connector of claim 7, wherein the second gap is formed between a pair of concave curved inwardly facing resiliently flexible plates.

16. The electrical cable connector of claim 7, wherein both the first gap and the second gap are each formed between a pair of inwardly facing resiliently flexible convex plates.

* * * * *